United States Patent [19]

Clark

[11] 4,014,381

[45] Mar. 29, 1977

[54] AIR CONDITIONING SYSTEM

[75] Inventor: William E. Clark, Syracuse, N.Y.

[73] Assignee: Carrier Corporation, Syracuse, N.Y.

[22] Filed: Jan. 20, 1976

[21] Appl. No.: 650,660

Related U.S. Application Data

[62] Division of Ser. No. 527,991, Nov. 29, 1974, Pat. No. 3,952,795.

[52] U.S. Cl. ..... 165/2; 98/40 D; 165/30; 165/40; 165/59; 165/96; 236/1 C

[51] Int. Cl.[2] ..... F25B 29/00

[58] Field of Search ..... 236/1 C, 80 B, 149, 236/91; 165/1, 2, 16, 59, 54, 30, 40, 96; 98/40 D, 33 A; 62/259

[56] References Cited

UNITED STATES PATENTS

| | | | |
|---|---|---|---|
| 3,623,543 | 4/1970 | Ostrander | 165/26 |
| 3,664,253 | 5/1972 | Asker | 165/59 |
| 3,867,980 | 2/1975 | Traver | 165/54 |

*Primary Examiner*—C. J. Husar
*Assistant Examiner*—Daniel J. O'Connor
*Attorney, Agent, or Firm*—J. Raymond Curtin; Barry E. Deutsch

[57] ABSTRACT

An air conditioning system for conditioning air in a plurality of enclosed areas in a building. Conditioned air at a temperature level which may be varied is supplied to first terminal means for discharge into an area. Conditioned air at a relatively constant temperature level is delivered to second terminal means for discharge into the area. The quantity of constant temperature air discharged into the area is regulated in accordance with the temperature level therein. When the temperature of the variable temperature air supply is at a relatively warm level, the quantity thereof discharged into the area is regulated in accordance with the quantity of constant temperature air discharged into the area. As the quantity of constant temperature air discharged into the room is increased, the quantity of warm air discharged into the room is decreased; and as the quantity of constant temperature air discharged into the room is decreased, the quantity of warm air discharged into the room is increased.

1 Claim, 3 Drawing Figures

AIR CONDITIONING SYSTEM

This is a division of application Ser. No. 527,991 filed Nov. 29, 1974, now U.S. Pat. No. 3,952,795.

BACKGROUND OF THE INVENTION

This invention relates to air conditioning systems for conditioning air in a plurality of areas or spaces in a common enclosure, and more particularly, relates to a control for regulating the operation of such system.

In recent years, many multi-zone buildings, such as schools, offices, apartments and hospitals have employed central station air conditioning systems to provide conditioned air to regulate the psychometric properties of the air in each of the zones of the building. One air conditioning system that has enjoyed widespread commercial success is known as a dual conduit system. A dual conduit system is designed to supply two air streams to enclosed areas or rooms that have a reversing transmission load; that is, during summer heat flows from the ambient and into the building, whereas during winter, heat flows from the building to the ambient. One air stream, called secondary air, is cooled the year round and is constant in temperature and variable in volume. Secondary air is a constant temperature-variable volume of air stream. The other air stream, called the primary air, is constant in volume and the air temperature is varied; it is warm in winter and cool in summer. Primary air is, therefore, a constant volume-variable temperature air stream. To obtain the two air streams, central station air conditioning apparatus is employed to provide the air temperature and volumes required.

The primary air conditioning apparatus varies the psychometric properties of the air supplied thereto, which may comprise a mixture of outdoor and return air or under some conditions, may comprise all return air. The apparatus includes filters to remove dirt or foreign matter entrained in the air, preheat coils as required to temper cold winter air, a humidifier to add winter humidification and a dehumidifier to remove excess moisture and to cool the supply air furnished at a constant volume to the enclosed areas within the building.

The secondary air conditioning apparatus also varies the psychometric properties of the air supplied thereto and supplies either/or all return air, a mixture of outdoor and return air, or all outdoor air, depending upon the season. The apparatus contains filters to remove dirt and foreign matter entrained in the air and a dehumidifier to remove excess moisture and/or to cool the supply air.

A refrigeration machine is necessary to complete the overall system. Any of the three basic refrigeration cycles, absorption, reciprocating, or centrifugal may be considered for the refrigeration equipment. Either chilled water from the refrigeration machine or direct expansion of refrigerant may be used to obtain the desired temperature for the supply air. The foregoing system is completely described in U.S. pat. No. 2,609,743, issued Sept. 9, 1952, in the names of Carlyle M. Ashley and William T. McGrath.

Typically, the primary air supply is connected to an air conditioning terminal serving the peripheral portion of the enclosed area or room. The secondary air supply is connected to a terminal serving the interior portion of the room. The delivery of air to each of the two separate portions of the room may actually be accomplished via a single air conditioning terminal of the type disclosed in copending United States application Ser. No. 311,076, filed Dec. 1, 1972 now U.S. Pat. No. 3,867,980 in the name of Darwin G. Traver, and assigned to the same assignee as the assignee of the present application. Alternatively, the supply of conditioned air to the two separate portions of the enclosed area may be accomplished via two separate air conditioning terminals. The discharge of primary air is designed to offset transmission gains or losses; whereas the discharge of conditioned secondary air is designed to offset a relatively constant heating load created by lights, people, and machinery.

Heretofore, the supply of secondary air has been maintained completely independent from the supply of primary air. That is to say, there has been no interrelationship between the quantity of secondary air discharged into the space and the quantity of primary air discharged thereinto.

During the heating season, this lack of interdependence between the supply of primary air and secondary air has resulted in the simultaneous discharge of both relatively warm and cold air into the area. As is manifest, the foregoing is not desirable when conservation of energy and the reduction of operating costs are desired.

In order to prevent conditions from occurring wherein, in effect, the supply of conditioned secondary and primary air streams are "bucking" each other, it is desirable to control the quantity of primary air discharged inversely to the quantity of secondary air supplied into the space or area. For example, during the heating or winter season, designers and installers of systems of the type described, have assumed once the ambient temperature declined below a certain level, for example 50° F, relatively warm primary air would always be required to offset transmission losses to the ambient through the peripheral walls of the building. However, there are times during winter operation, the presence of solar radiation will negate transmission losses to the ambient, thereby making the continued discharge of relatively warm primary air undesirable.

In effect, during the heating season, it is desirable to change the primary air system from a constant volume supply to a variable volume supply. Although separate thermostats may be employed to achieve the foregoing, the attendant increase in installation costs that would result from the duplication of thermostats would be undesirable, particularly where one of the thermostats would function only during the heating season. Additionally, with two separate thermostats, each thermostat may be separately set so that warm primary and cold secondary air may be simultaneously discharged. As noted heretofore, the simultaneous discharge of the separate air streams is undesirable, particularly when the conservation of energy is critically important.

Some system designers have attempted to compensate for solar radiation by employing devices to sense solar rays. Such devices are not always reliable, nor do they take into account the storage effect of the peripheral walls of the building. Thus, although there is always a time lag between the introduction or withdrawal of solar rays and the effect of such rays on transmission gains or losses, solar compensating devices do not take such time lag into consideration. Accordingly, the actual requirements of an area or space may be somewhat different than the theoretical requirements as determined by the absence or presence of solar radiation.

SUMMARY OF THE INVENTION

It is an object of the present invention to control the quantity of warm primary air discharged into an area inversely to the quantity of secondary air discharged thereinto.

It is a further object of this invention to reduce the quantity of warm primary air discharged into an area as the quantity of secondary air discharged thereinto is increased and to increase the quantity of primary air as the quantity of secondary air is decreased.

It is another object of this invention to generate a control signal indicative of the quantity of secondary air discharged into an area and to regulate the quantity of warm primary air discharged thereinto in accordance with the magnitude of the generated control signal.

It is another object of this invention to utilize the thermostat employed in regulating the quantity of secondary air discharged into an area, to additionally regulate the quantity of warm primary air discharged thereinto.

It is yet another object of this invention to utilize a thermostat employed in regulating the quantity of relatively cold secondary air discharged into a space to accommodate the storage in the perimeter walls of a building as opposed to utilizing a control responsive directly to solar radiation.

It is still another object of this invention to utilize controls normally supplied with air conditioning terminals employed in systems of the type described to regulate both the quantity of secondary air and warm primary air supplied to a space.

These and other objects of the present invention are obtained in an air conditioning system for conditioning air in a plurality of enclosed areas in a building. Conditioned air at a temperature level which may be varied is supplied to first terminal means for discharge into an area. Conditioned air at a relatively constant temperature level is delivered to second terminal means for discharge into an area. The quantity of constant temperature air is regulated in accordance with the temperature requirements of the area. A control signal, the magnitude thereof being indicative of the quantity of constant temperature air discharged into the area, is generated, and is supplied to control means operable to vary the quantity of warm variable temperature air supplied into the area in accordance with the magnitude of the control signal. As the quantity of constant temperature air discharged into the room is increased, the quantity of warm air discharged into the room is decreased; and as the quantity of constant temperature air discharged into the room is decreased, the quantity of warm air discharged into the room is increased.

DESCRIPTION OF THE PREFERRED EMBODIMENT

Figure 1:
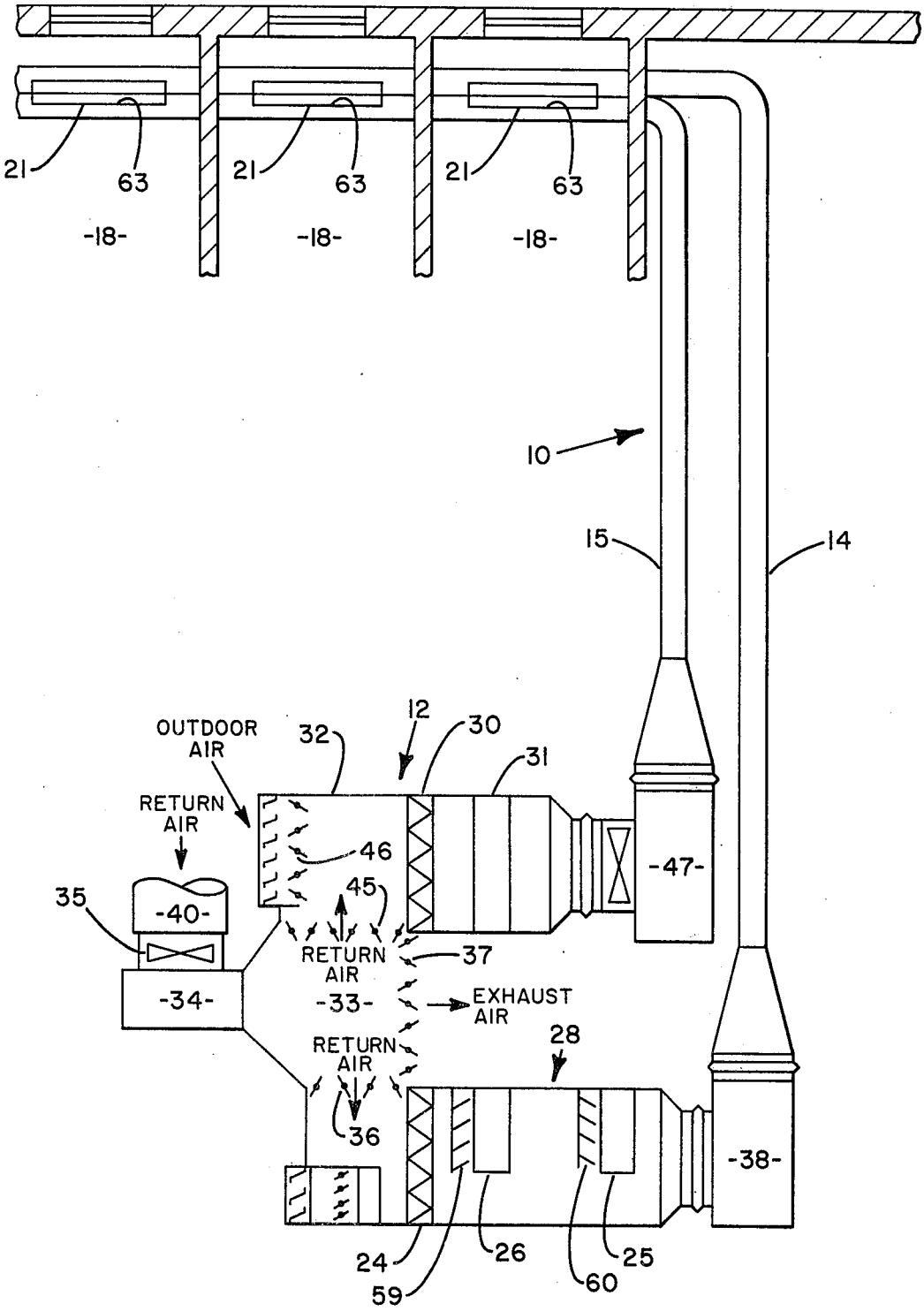
FIG. 1 schematically illustrates an air conditioning system in accordance with the present invention.

Referring now to FIG. 1, there is shown an air conditioning system of a type to which the present invention pertains. Air conditioning system 10, which may be described as a central station type, includes an air conditioning equipment section generally designated by the numeral 12, and a conduit system 14, 15, for conducting conditioned primary and secondary air respectively, to each of the areas or rooms provided within a common enclosure and served by the system. Equipment section 12 may be located in a basement or on the roof of a building.

For the purpose of this description, primary air may comprise fresh air or ventilating air drawn from the outdoors, or a mixture of outdoor air and return air treated in section 12, while secondary air may comprise return air from the areas being conditioned and treated in section 12. The apparatus for conditioning the primary air preferably includes a filter 24 to remove foreign matter entrained in the air, heating or reheating coil 26 to elevate the temperature of the air flowing in the primary air system or circuit and a cooling or dehumidifying coil 25 to remove excess moisture and to cool the supply air as required, arranged in series flow relationship and encased within a suitable housing 28. The passage of primary air over coils 25 and 26 is regulated by dampers 59 and 60.

The portion of the central station equipment regulating the secondary air preferably includes a suitable filter 30 to remove foreign matter entrained in the air and a dehumidifier or cooling coil 31 to remove the excess moisture and/or cool the supply air, arranged in series flow relationship and encased within a suitable housing 32. Chilled water is supplied to coils 25 and 31 via suitable means (not shown).

Housings 28 and 32 are connected by duct 33 with return air exhaust fan 34. The inlet of fan 34 is connected with return air plenum 40 which is connected by suitable means (not shown) with the areas or rooms being served by the air conditioning system. Preferably, inlet air control vanes 35 are provided to vary the flow of air through fan 34. Adjustable members 36 are provided to vary the flow of return air to the primary air conditioning apparatus. The exhaust dampers 37 connect exhaust duct 33 with the outdoors. Dampers 37 control the volume of return air discharged to the atmosphere. Housing 28 connects with primary air fan 38. Conduit means 14 conveys primary air from fan 38 to the areas or rooms being conditioned. Housing 32 is connected to the outlet of return air fan 34. Preferably adjustable dampers 45 are provided to vary the flow of supply air to the secondary air conditioning apparatus. Adjustable dampers 46 are provided to regulate the flow of outdoor air to the secondary air conditioning apparatus. Conduit means 15 conveys air from fan 47 to the area or rooms being conditioned. Conduit means 14 and 15 provide the primary air and secondary air respectively to each air terminal 21 disposed in each of the respective areas or rooms 18.

Figure 2:
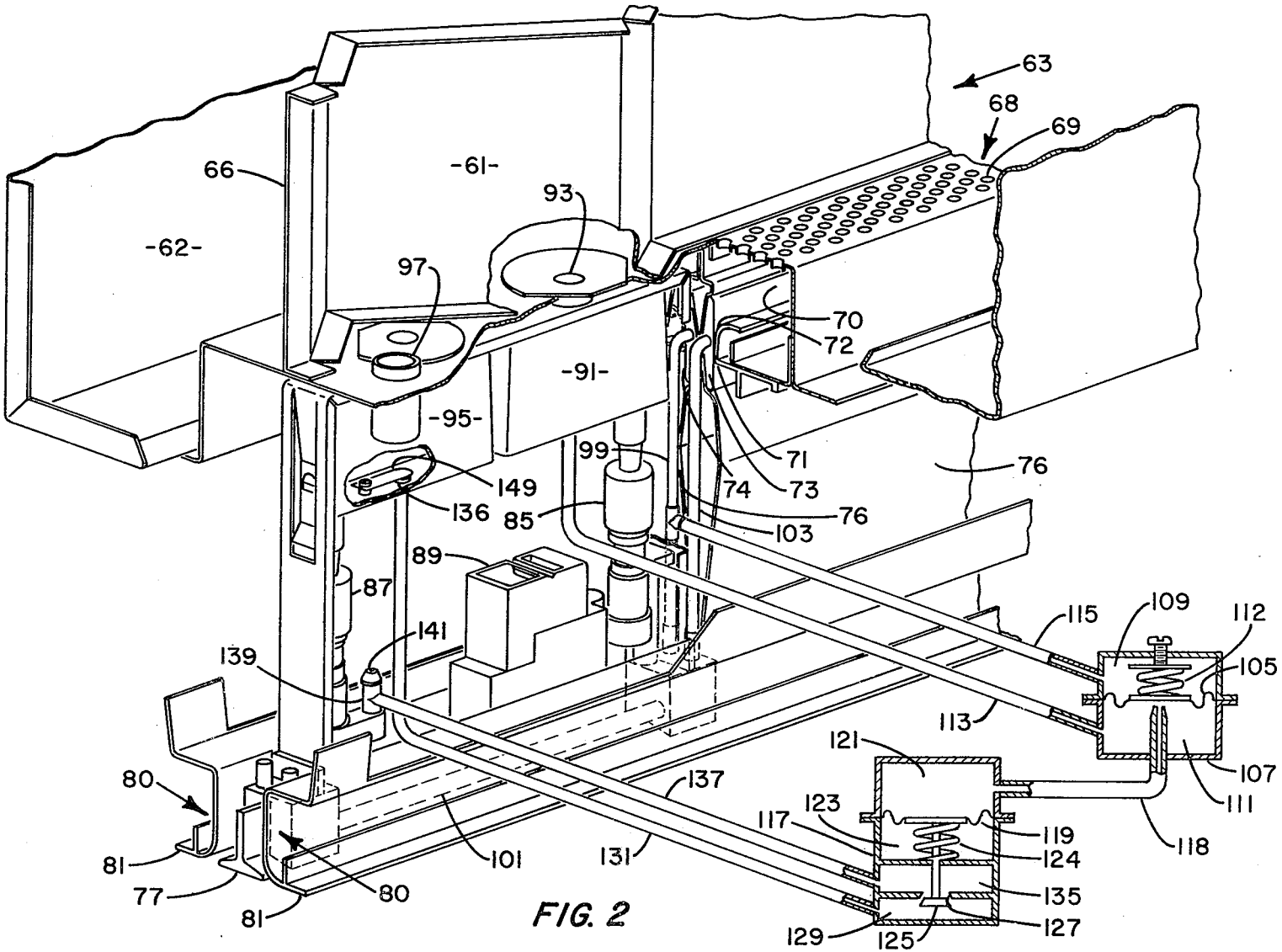
FIG. 2 illustrates a perspective view of an air conditioning terminal with a control therefore, illustrated partially in section and partially in schematic.
Figure 3:
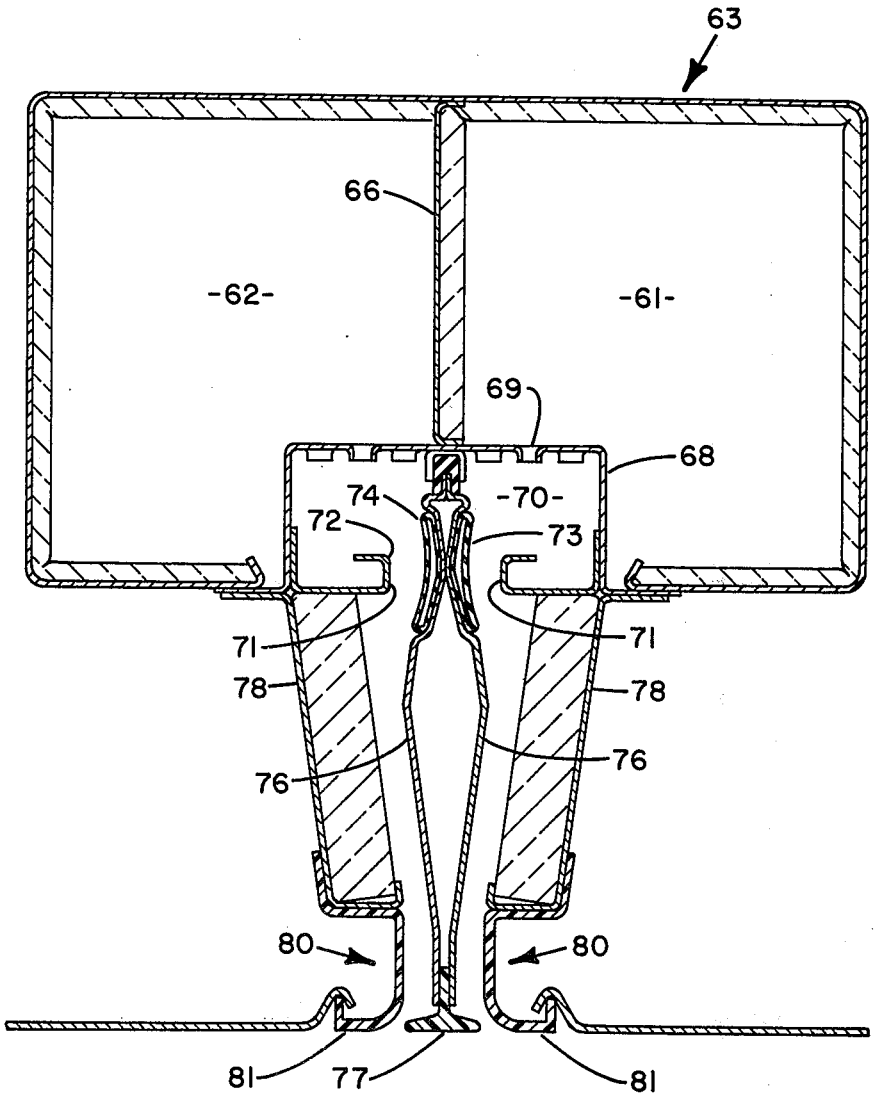
FIG. 3 is a sectional view of the air conditioning terminal illustrated in FIG. 2.

Referring now to FIGS. 2 and 3 there is disclosed a preferred form of terminal and a control therefore in accordance with the present invention. In a typical system of the type to which the present invention relates, a separate terminal, to be described in detail hereinafter, will be disposed in each individual space or room being conditioned. Conduit means 14 and 15 terminate in a plenum section 63 of each terminal. The plenum section is ordinarily lined with a sound absorbing material, such as a glass fiber blanket. A baffle or partition member 66 divides the plenum into first and second sections or portions 61 and 62 for respective connection to conduit means 14 and 15. The baffle thereby maintains the primary air separate from the secondary air so that there is no intermixing therebetween.

An air supply distribution plate 68 having a plurality of openings 69 is provided to evenly distribute the supply air from plenum 63 to distribute chamber 70 which is defined by the top and side walls of distribution plate 68. A portion of the distribution plate is disposed on either side of baffle 66 so primary air moves into a first portion of distribution chamber 70 and secondary air moves into a second portion of the chamber.

The bottom of distribution chamber 70 includes aligned cutoff plates 71 which are provided with a curved surface 71 for engagement by bladders or bellows 73 and 74 to form a damper. By varying the inflation of the bladders, the area of the opening between each of the bladders and cutoff plates may be varied to thereby regulate the quantity of conditioned air discharged into the area or space being conditioned. The manner in which the inflation of the bladders is controlled shall be explained in detail hereinafter.

The bladders are adhesively mounted on a central partition assembly comprised of opposed generally convex plates 76 and a diffuser triangle 77. The plates have a V-shaped recessed area so the bladders are completely recessed within the plates when deflated. This provides a large area between the active walls of the bladders and the cutoff plates for maximum air flow therebetween. Further, the recessed bladder provides a smooth surface along plate 76 to minimize air turbulence.

The damper mechanism is disposed a substantial distance upstream from the discharge openings in the terminal to provide sufficient space therebetween to absorb any noise generated by the damper mechanism. For maximum sound absorption, downwardly extending walls 78 which form air passages in conjunction with plates 76 are lined with a suitable sound absorbing material, such as a glass fiber blanket. Outlet members 80 having outwardly flared portions 81 are affixed, as by welding, to walls 78. For a more detailed explanation of the air terminal, reference may be made to copending United States patent application, Ser. No. 311,076, filed Dec. 1, 1972 now U.S. Pat. No. 3,867,980 in the name of Darwin G. Traver and assigned to the same assignee as the assignee thereof.

The terminal further includes a control section comprising a first regulating device 85, a second regulating device 87, and a thermostat 89. Preferably, regulators 85 and 87 are of the type disclosed in U.S. pat. No. 3,434,409, issued in the name of Daniel A. Fragnito, and thermostat 89 is of the type disclosed in U.S. pat. No. 3,595,475, issued in the name of Daniel H. Morton. Each of the foregoing patents are assigned to the same assignee as the assignee hereof.

Regulator 85 is responsive to the pressure of the secondary air supplied via conduit means 15 to plenum portion 62. Thermostat 89 is suitably operably connected to regulator 85 for a reason to be more fully described hereinafter. A filter 91 is provided to filter the secondary air passing from plenum section 62 to the regulator via opening 93.

Similarly, a filter 95 is provided to filter the primary air passing to regulator 87 from plenum section 61 via opening or orifice 97. Openings 93 and 97 are provided on opposite sides of baffle plate 66. Regulator 85 is suitably joined via line 99 to the bladder regulating the discharge of secondary air from plenum section 62 through the terminal. Similarly, regulator 87 is joined via lines 101 and 103 to the bladder regulating the discharge of primary air from plenum section 61. Regulators 85 and 87 are provided to generate a control signal indicative of the pressures of the secondary and primary air in the respective plenum sections. The regulators increase a control signal supplied to the bladders to thereby increase the inflation thereof as the air pressure in the plenums increase and operate to decrease the magnitude of the control signal supplied to the bladders as the pressure of the air in the plenum sections decrease. By varying the inflation of the bladders or bellows in accordance with changes in supply air pressure, a relatively constant quantity of air may be discharged from the unit or terminal irrespective of variations in supply air pressure.

As noted before, thermostat 89 is associated with regulator 85. Thermostat 89 is preferably a bleed type thermostat which operates to reduce the pressure signal supplied from regulator 85 to the bladder as the temperature of the space increases above the design level to thereby decrease the inflation of the bladder and increase the quantity of conditioned air supplied into the space. If the temperature of the space falls below the set point temperature, the thermostat bleed closes to increase the magnitude of the control signal supplied to the bladder so that it approaches its maximum value as determined by the supply air pressure. The resultant increase in the magnitude of the signal will cause the bladder to inflate to decrease the quantity of secondary air supplied to the space.

As noted before, the supply of primary air into each space, as controlled by regulator 87 is normally substantially constant. The primary air temperature is varied in accordance with ambient temperature to offset transmission gains or losses. Accordingly, a thermostat is generally omitted from the control section regulating the supply of primary air into the space.

There are times during the winter season when solar radiation negates transmission losses and the supply of warm primary air is not actually required. Heretofore, the supply of warm air in systems of the type described could not be regulated in accordance with actual temperature conditions in the space. That is, unless a separate thermostat were provided, only operable during the heating season, the supply of warm air was maintained at a constant level irrespective of actual requirements in the separate areas.

To overcome the foregoing problem, the present invention includes a pneumatic valve 107. Valve 107 includes a bellows or diaphragm 105 separating the valve into an upper section 109 and a lower section 111. A line 113 communicates lower valve section 111 with plenum section 62 so that the lower surface of diaphragm 105 is responsive to the pressure of the air in the plenum section. A conduit 115 communicates upper section 109 with a portion of the system that is at the pressure of the bladder or bellows controlling the discharge of secondary air, for example line 99. Accordingly, the upper surface of diaphragm 105 is subjected to bladder pressure. Control valve 107 further includes an adjustable spring 112 or similar means to provide an additional force on the upper surface of diaphragm 105. A line 118 communicates lower valve section 111 with a second valve 117. Valve 117 has a diaphragm 119 separating the valve into upper and lower sections respectively 121 and 123. Adjustable spring 124 provides a second force on the lower surface of diaphragm 119. A valve 125 is provided to control the flow of air through orifice 127. Section 129 of valve 117 communicates with a line 131 having air at primary air supply pressure flowing therethrough. Line 131 terminates at one end in orifice 136 provided in filter 95. Opening of valve 125 permits the primary air to flow from section 129 to section 135 and thence via line 137 to a connection point 139 in valve 87 located between bleed opening 141 and the connection point for the air supplied to the inflatable bellows via line 101. A valve member 149 is provided to selectively open line 131 for the passage of air therethrough. Preferably, valve 149 is responsive to the temperature of the supply air and opens when the supply air temperature is at a relatively warm level for a reason to be more fully explained.

OPERATION

Assume the system is operating during winter conditions. Accordingly, the primary air supplied via conduit means 14 to plenum section 61 is at a relatively warm temperature level to compensate for transmission losses to the ambient. The supply of secondary air through conduit means 15 to plenum section 62 is at a relatively cold level.

The quantity of secondary air discharged into the area or space being conditioned is under the control of both regulator 85 and thermostat 89 whereby the quantity of air discharged is varied in accordance with the temperature demands of the space.

Even though the ambient temperature is at a relatively low level, there are times when transmission losses will be compensated for by solar radiation and thus the discharge of relatively warm primary air is not required.

When solar radiation is negating transmission losses, the continued discharge of relatively warm primary air raises the temperature level in the space so that thermostat 89, in conjunction with regulator 85, operate to reduce the pressure signal supplied to the bladder regulating the flow of secondary air into the space. The bladder is deflated as a result of the reduced pressure signal to thereby permit a greater quantity of secondary air to be discharged into the area.

As noted before, line 113 communicates the pressure signal to the secondary air control bladder with the top section 109 of valve 107. As the magnitude of the pressure signal is decreased, as a result of the requirement for a greater quantity of secondary air in the space, the primary air signal provided to lower section 111 of the valve via line 113, causes diaphragm 105 to lift to thereby open line 118 for air flow from section 111 to section 121 of valve 117. The resulting pressure increase on the top surface of diaphragm 119 of valve 117 causes valve member 125 to move downwardly to open orifice 127 to permit the flow of air from section 129 to section 135 and thence to line 137. The pressure of the air passing through line 137 will vary in accordance with changes in the magnitude of the control signal supplied to the secondary air regulating bladder. As noted before, the magnitude of such control signal will vary in response to changes in room temperature. Valve 125 will vary the active opening of orifice 127 to thus vary the magnitude of the air pressure control signal passing through line 137.

Since the primary air supply is at a relatively warm level, bimetallic valve 149 is open to permit air at primary air pressure to flow from plenum section 61 through line 131 and hence to line 137. The control signal passing through line 137 to connection point 139 of regulator valve 87 results in air increase in the magnitude of pressure signal communicated to the primary air control bladder. This is as a result of the control signal provided via line 137 preventing the bleeding of air to the atmosphere via opening 141. In effect, the control signal develops a "back pressure" which forces the air, flowing through regulator 87 to pass to the primary air bladder via lines 101 and 103. The bladder is inflated to thereby decrease the quantity of primary air discharged into the area. Thus, the supply of relatively warm air is reduced as desired in accordance with actual transmission losses. This minimizes operating costs and improves overall efficiency of the system.

As transmission losses to the ambient increase, the temperature level of the area being conditioned decreases. Thermostat 89 in conjunction with regulator 85 increase the magnitude of the pressure signal supplied to the secondary air bladder to increase the inflation thereof to thereby decrease the quantity of relatively cold secondary air supplied to the space.

Essentially, as the bladder pressure increases to decrease the quantity of conditioned secondary air discharged, the air pressure in sections 109 and 111 of valve 107 approach equality. Accordingly, diaphragm 105 is formed downwardly due to the greater force acting on the top face thereof by the additive forces produced by the air pressure and the spring, to first reduce and then eliminate the flow of air through conduit 118. The resulting decrease in the force acting on the top surface of bladder 119 of valve 117 enables the spring force to raise valve 125 to gradually close orifice 127.

The foregoing events result in a reduction of the flow of air through conduit 137 to connection point 139 of regulator 87. The resultant reduction in the back pressure permits a greater quantity of primary air passing through regulator 87 to bleed to the atmosphere via orifice 141, thereby decreasing the magnitude of the primary air pressure signal supplied to the primary air control bladder. The foregoing events will result in deflation of the bladder thereby permitting an increase in the quantity of primary air supplied to the space being conditioned.

When the air conditioning system is functioning during summer conditions, the supply of primary air is at a relatively cold temperature level. Valve 149 is responsive to the temperature of the primary air and will close orifice 136. This results in the discontinuance of all flow of air through lines 131 and 137 to thereby place the operation of regulator 87 solely under the control of the primary air supply pressure.

It should be understood, various modifications may be made without departing from the scope of the invention. For example, the pressure signal through line 137 may be brought directly to bellows 73. In addition, it would be possible to eliminate valve 117 if primary air and secondary air supply pressures are substantially equal. In such a situation, line 131 would be connected to chamber 111 of valve 107. Line 118 would then be led directly to connection point 139.

While a preferred embodiment of the present invention has been described and illustrated, the invention should not be limited thereto, but may be otherwise embodied within the scope of the following claims.

I claim:

1. A method of operating an air conditioning system for conditioning air in a plurality of enclosed areas in a building, each of the enclosed areas having a peripheral portion requiring conditioned air having a variable temperature, and an interior portion requiring conditioned air at a constant temperature, comprising the steps of:

delivering a first conditioned air stream to a terminal serving the peripheral portion of said area, the temperature of said conditioned air being varied in accordance with the temperature of the ambient air;

delivering a second conditioned air stream to a terminal serving the interior portion of said area, the temperature of said air being maintained at a relatively constant level;

regulating the quantity of the relatively constant temperature conditioned air discharged from said terminal to said area in accordance with the temperature conditions within the area;

generating a control signal, the magnitude of the signal varying in accordance with the quantity of constant temperature conditioned air supplied to the area;

sensing the temperature of the first conditioned air supply;

delivering the control signal, when the temperature of the first conditioned air supply is relatively warm, to a control operable to regulate the quantity of said relatively warm conditioned air discharged into said area from the first terminal portion;

increasing the quantity of relatively warm air discharged into said area when the magnitude of the control signal varies to indicate that the quantity of said constant temperature air discharged into said area is decreasing; and decreasing the quantity of relatively warm air discharged into said area when the magnitude of the control signal varies to indicate that the quantity of said constant temperature air discharged into said area is increasing.

* * * * *